US005410936A

United States Patent [19]

Ellsworth et al.

[11] Patent Number: 5,410,936

[45] Date of Patent: May 2, 1995

[54] MUSICAL INSTRUMENT BRIDGE

[75] Inventors: Lynn K. Ellsworth, Federal Way; John D. Shaneyfelt, Auburn, both of Wash.

[73] Assignee: The 2TEK Corporation, Kent, Wash.

[21] Appl. No.: 68,541

[22] Filed: May 27, 1993

[51] Int. Cl.[6] ..... G10D 3/04

[52] U.S. Cl. ..... 84/298; 84/307; 84/267

[58] Field of Search ..... 84/297 R, 298, 299, 84/307, 308, 309, 267, 268, 269, 274, 312, 313, 294

[56] References Cited

U.S. PATENT DOCUMENTS

| | | | |
|---|---|---|---|
| 608,279 | 8/1898 | Benson | 84/267 |
| 870,283 | 11/1907 | Green | 84/297 R |
| 1,259,062 | 3/1918 | Wilbur | 84/297 R |
| 2,828,660 | 4/1958 | Paulsen | 84/312 R |
| 3,251,257 | 5/1966 | Bunker | 84/267 |
| 3,353,433 | 11/1967 | Webster | 84/294 |
| 3,439,571 | 4/1969 | Ryan | 84/312 R |
| 4,201,108 | 5/1980 | Bunker | 84/267 |
| 4,253,371 | 3/1981 | Guice | 84/267 |
| 4,742,750 | 5/1988 | Storey | 84/313 |
| 5,018,423 | 5/1991 | Bunker et al. | 84/293 |
| 5,198,601 | 3/1993 | McCabe | 84/298 |

OTHER PUBLICATIONS

PBC Guitar-Bridge Advertisement, PBC Guitar Technology Inc., 7483 South Main St., Coupersburg Pa., 1992.

*Primary Examiner*—Richard A. Wintercorn
*Assistant Examiner*—Cassandra C. Spyrou
*Attorney, Agent, or Firm*—Christensen, O'Connor, Johnson & Kindness

[57] ABSTRACT

Disclosed is a musical instrument bridge for supporting a set of strings above a front face of a musical instrument. The bridge comprises a plate, a mounting block, and a plurality of fingers. The plate is attachable to a rear face of the instrument. The plurality of fingers are attached to the plate and extend towards a front face of the instrument. Each finger has a resonant frequency that is related to a predetermined pitch of the string supported by the finger. Each finger is designed to vibrate in a plane that is parallel to the front face of the instrument but to reduce vibration in a plane perpendicular to the front face of the instrument.

16 Claims, 6 Drawing Sheets

MUSICAL INSTRUMENT BRIDGE

FIELD OF THE INVENTION

The present invention relates to musical instruments in general, and in particular to musical instrument bridges.

BACKGROUND OF THE INVENTION

In recent years, significant improvements have been made in the quality of musical instruments, particularly electric instruments such as electric guitars and electric bass guitars. However, the majority of the improvements that have occurred in such instruments are due to improvements made in the electronic components used with such instruments. These electronic components include pickups, amplifiers and special effects. One component of a musical instrument that has remained virtually unchanged since the first electric instruments were introduced is the instrument bridge.

A bridge on a musical instrument is designed to support a set of strings at a predetermined distance above the instrument's fretboard. It has been discovered that prior art bridges are the source of, or at least contribute to, three errors in the production of sound from an instrument. The first error is interstring modulation, whereby striking one string causes another string on the instrument to vibrate. If the pitch of the vibrating strings are not harmonically related, such interstring modulation can produce unclear, distorted sounds. The second problem associated with traditional instrument bridges is the fact that they dampen a string's vibration once it is played. This is particularly true of tremolo-type bridges that are coupled to the body of a musical instrument via one or more springs. These springs dissipate a portion of the energy of a plucked string, thereby reducing the sustain of a note played. The third problem contributed by prior art bridge designs is the signal distortion that occurs after the string is struck. When a string is initially struck, the string moves back and forth in a plane that is substantially parallel to the front face of a musical instrument and perpendicular to a magnetic field produced by an instrument pickup. This parallel movement produces the cleanest sound with the fewest undertones and overtones. However, shortly after the string is struck, the plane in which the string is vibrating begins to rotate in an elliptical fashion. As the plane of the string vibration changes, the signal produced by the pickup begins to sound slightly distorted.

In order to solve the problems associated with prior art bridge designs, there is a need for a musical instrument bridge that reduces interstring modulation, does not excessively dampen a string's vibration and confines a strings vibration to a single plane that is substantially perpendicular to the direction of a magnetic field produced by a pickup.

SUMMARY OF THE INVENTION

The present invention is a musical instrument bridge that supports a set of strings at a predetermined distance above a front face of a musical instrument. Each string supported by the bridge is tuned to a predetermined pitch when the musical instrument is played. The bridge includes a plate that is secured to a rear face of a musical instrument and a plurality of fingers that are secured to the plate and extend towards a front face of the musical instrument. Each of the fingers includes a head portion that supports a string at the predetermined distance above the front face of the musical instrument, a base portion at which the finger is secured to the plate and a waist portion that extends between the base portion and the head portion. Each finger has a resonant frequency that is related to the predetermined pitch of the string supported by the finger.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
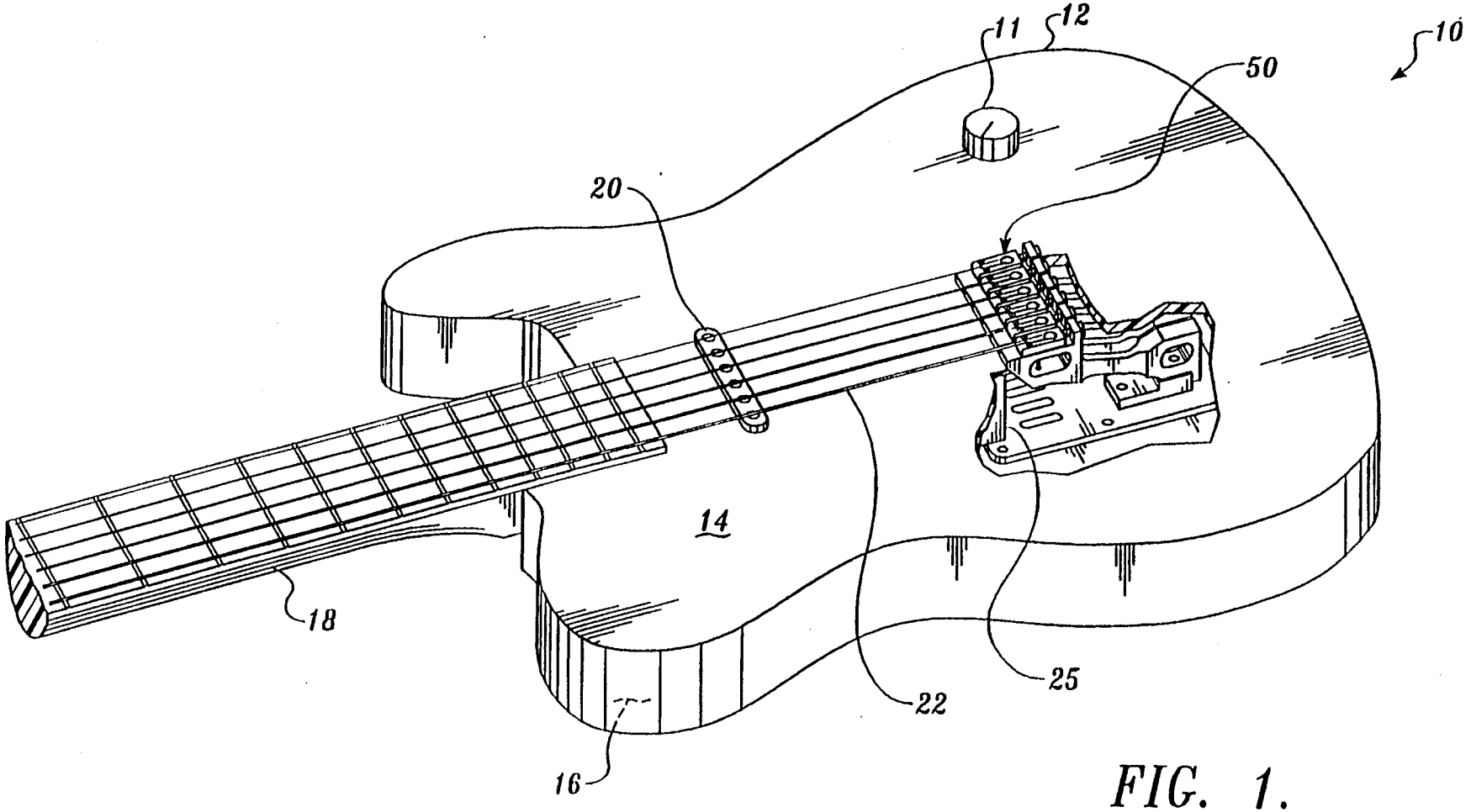
FIG. 1 is a cutaway view showing a musical instrument bridge according to the present invention disposed in an electric guitar.

FIG. 1 is a cutaway view of a musical instrument, namely, a conventional electric guitar 10, including a bridge 50 according to the present invention. The electric guitar 10 includes a body 12 having a front face 14, and a rear face 16, as well as a volume control 11, a fretboard 18, an electrical pickup 20 and a set of strings 22.

The bridge 50 is secured to the rear face 16 of the instrument and lies within a recessed area 25 of the instrument body 12 in the same fashion as existing tremolotype bridges are mounted in electric guitars. In fact, replacing the bridge of a standard electric guitar with a bridge according to the present invention does not require any major modifications to the guitar other than perhaps reshaping the recessed area 25 of the instrument body. The bridge 50 maintains the strings 22 at a predetermined position over the fretboard 18 and the pickup 20. As will be described in greater detail below, the bridge 50 according to the present invention improves isolation between the strings thereby reducing interstring modulation, increases the harmonic content and sustain of the strings while reducing distortion due to the orbital motion of a vibrating string.

Figure 2:
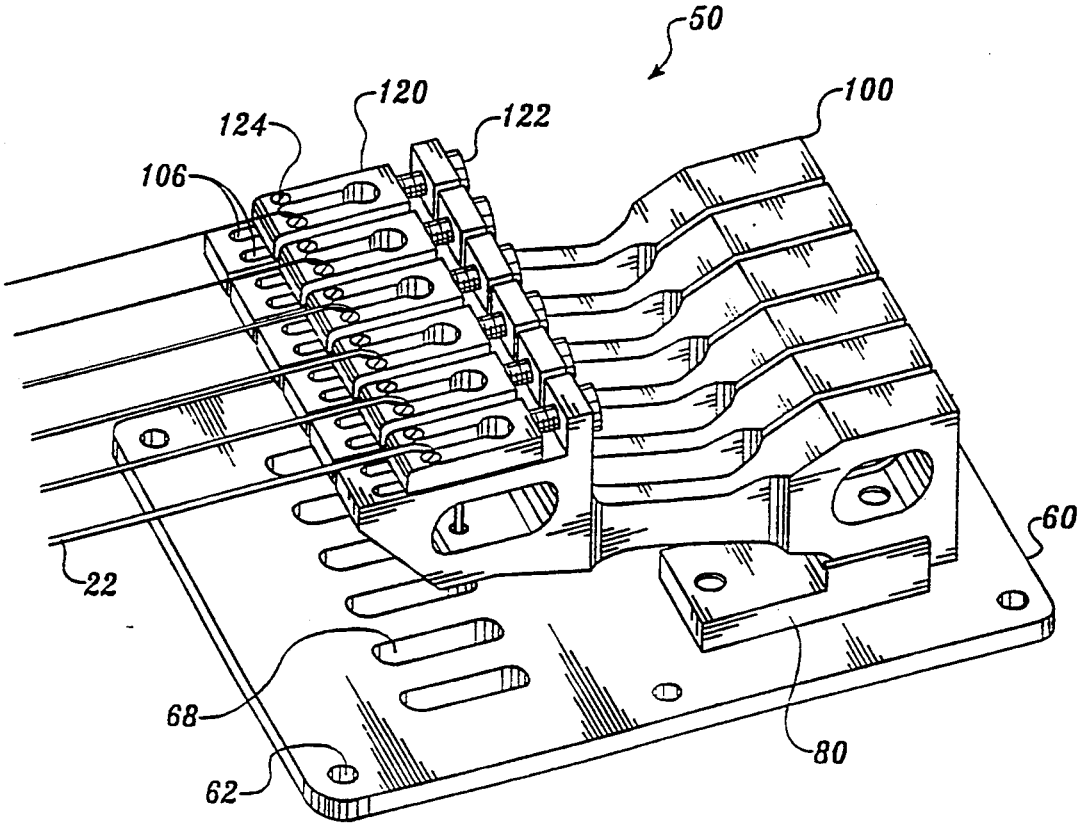
FIG. 2 is an isometric view of the musical instrument bridge according to the present invention.

FIG. 2 is an isometric view of the bridge 50 according to the present invention. The bridge includes a plate 60, a mounting block 80 and a plurality of fingers 100. Disposed on top of each of the fingers 100 is a conventional saddle 120 that is used to vary the height of a string 22 above the fretboard. Each saddle 120 includes an adjustment screw 122 for moving the body of the saddle closer to or farther away from the fretboard, as well as a pair of adjustment screws 124 to vary the height of the string 22 above the fretboard. The details of the saddle 120 are conventional and are well known to those of ordinary skill in the musical instrument arts.

As will be described in further detail below, each of the fingers 100 has a resonant frequency that is related to the pitch of the string 22 that is supported by the finger. The resonant frequency of each finger is selected assuming each string will be tuned to a standard predefined pitch. However, if it is desired to tune the instrument to something other than the standard tuning, it may be necessary to replace one or more fingers of the bridge with fingers that are designed for the alternate pitch. Additionally, because "most appropriate" resonant frequency for each finger is somewhat a matter of taste, it is possible that a finger having a fixed resonant frequency may sound acceptable for more than one tuning of the guitar. For the purposes of this specification, the terms "pitch" and "resonant frequency" are defined as being synonymous, with each term being used where appropriate for clarity.

Figure 3:
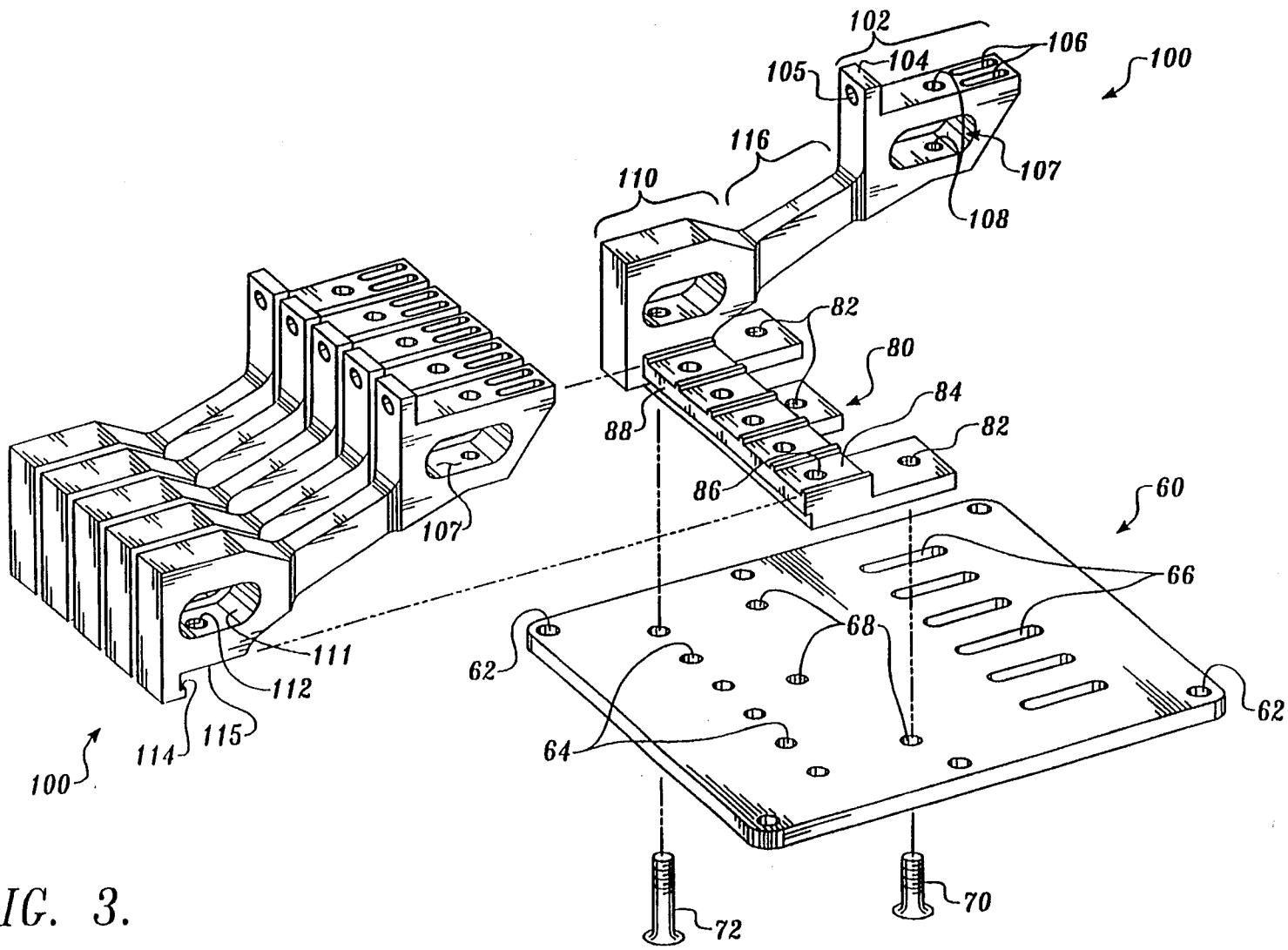
FIG. 3 is an exploded view of a musical instrument bridge according to the present invention.

FIG. 3 is an exploded view of the musical instrument bridge 50 described above. The plate 60 includes a plurality of holes 62 disposed around a perimeter of the plate through which a screw or other suitable fastening means may be inserted to secure the bridge 50 to the rear face 16 of the musical instrument as shown in FIG. 1. The plate 60 also includes a plurality of slots 66 through which a string may be threaded without removing the bridge 50 from the instrument. Finally, the plate 60 includes a plurality of holes 68 which align with a set of corresponding threaded holes 82 on the mounting block 80 and a number of holes 64, which are aligned with a corresponding set of holes 86 on the mounting block. A number of machine screws 70 or other suitable fasteners are used to secure the mounting block 80 to the plate 60.

The mounting block 80 also includes a series of unthreaded holes 86 through which a number of machine screws 72 or other suitable fasteners are passed. The machine screws 72 engage a threaded portion of the fingers 100 as will be described. The mounting block 80 includes a plurality of slots 84 in which the fingers 100 are fitted. Finally, the mounting block 60 includes an outwardly extending lip 88 that mates with a corresponding groove 114 on the fingers 100.

The shape of the mounting block 80 is determined by the type of instrument in which the bridge 50 is to be used. It may be necessary to make the mounting block taller or shorter to position the plurality of fingers so that the strings are at the correct height above the fret board of the instrument. Additionally, some portions of the mounting block may be removed to reduce the mass of the mounting block.

The finger 100 is roughly divided into three sections, a head portion 102, a base portion 110 and a waist portion 116 that connects the base portion to the head portion. The head portion 102 includes a saddle stop 104 having an unthreaded hole 105 therein. The hole 105 receives the adjustment screw 122 that secures the saddle 120 on top of the head portion of the finger. Also disposed on the head portion 102 are a set of grooves 106 that receive the adjustment screws 124 of the saddle as shown in FIG. 2. The grooves 106 maintain the alignment of the saddle on the head portion of the finger. Finally, the head portion includes an unthreaded hole 108 through which a musical instrument string is passed. A section 107 of the head portion 102 may be hollowed to reduce the mass of the head portion in order to adjust the resonant frequency of the finger as will be described below.

The base portion 110 includes a threaded hole 112 that receives the machine screw 72 to secure the finger to the mounting block 80 and the plate 60. The base portion also includes a groove 114 that receives the outwardly extending lip 88 of the mounting block in order to prevent the finger from rotating forward when the strings supported by the bridge are tightened. The base portion of the finger also includes a hollowed section 111, which reduces the mass of the base portion.

The waist portion 116 of the finger extends between the base portion 110 and the head portion 102. As seen in FIG. 2, the waist portion of the finger has a length dimension that is generally aligned in the lengthwise direction of the string that is supported by the finger. The waist portion has a width dimension that is parallel to the plane of the plate 60 and a height dimension that is perpendicular to the plane of the plate 60. In the present embodiment of the invention, the width dimension is smaller than the height dimension to allow the finger to vibrate in a plane parallel to the plane of the plate 60 but to substantially reduce vibration of the finger in a plane perpendicular to the plate 60.

Figure 4:
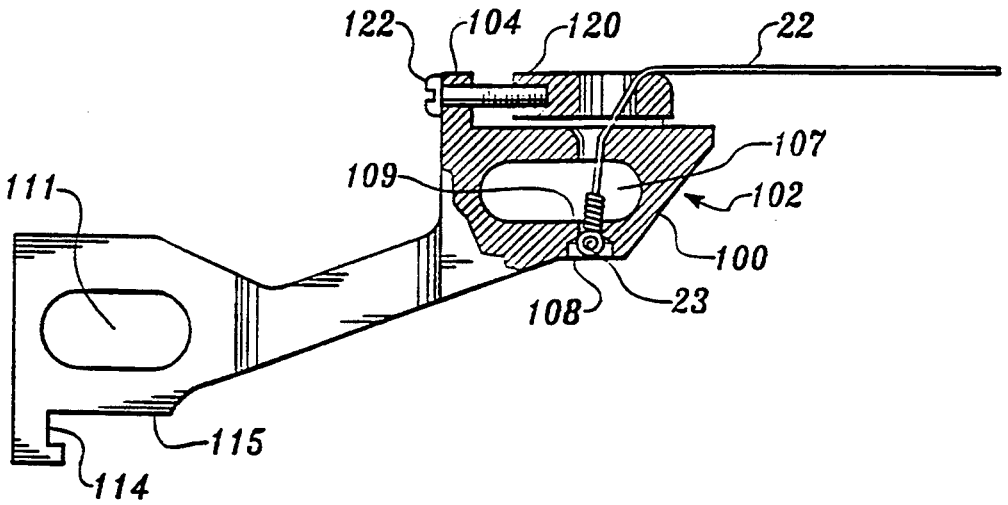
FIG. 4 is a cross-sectional view of the musical instrument bridge finger according to the present invention.

FIG. 4 shows a cross-sectional view of the finger 100 showing how the saddle 120 is secured. As described above, the head portion includes the saddle stop 104, which provides an abutment for the adjustment screw 122, which secures the saddle 120 to the finger. To secure the string 22 to the finger 100, the hole 108 includes a shoulder 109 that prevents a ball 23 at the end of the string 22 from being pulled through the hole 108.

Figure 5:
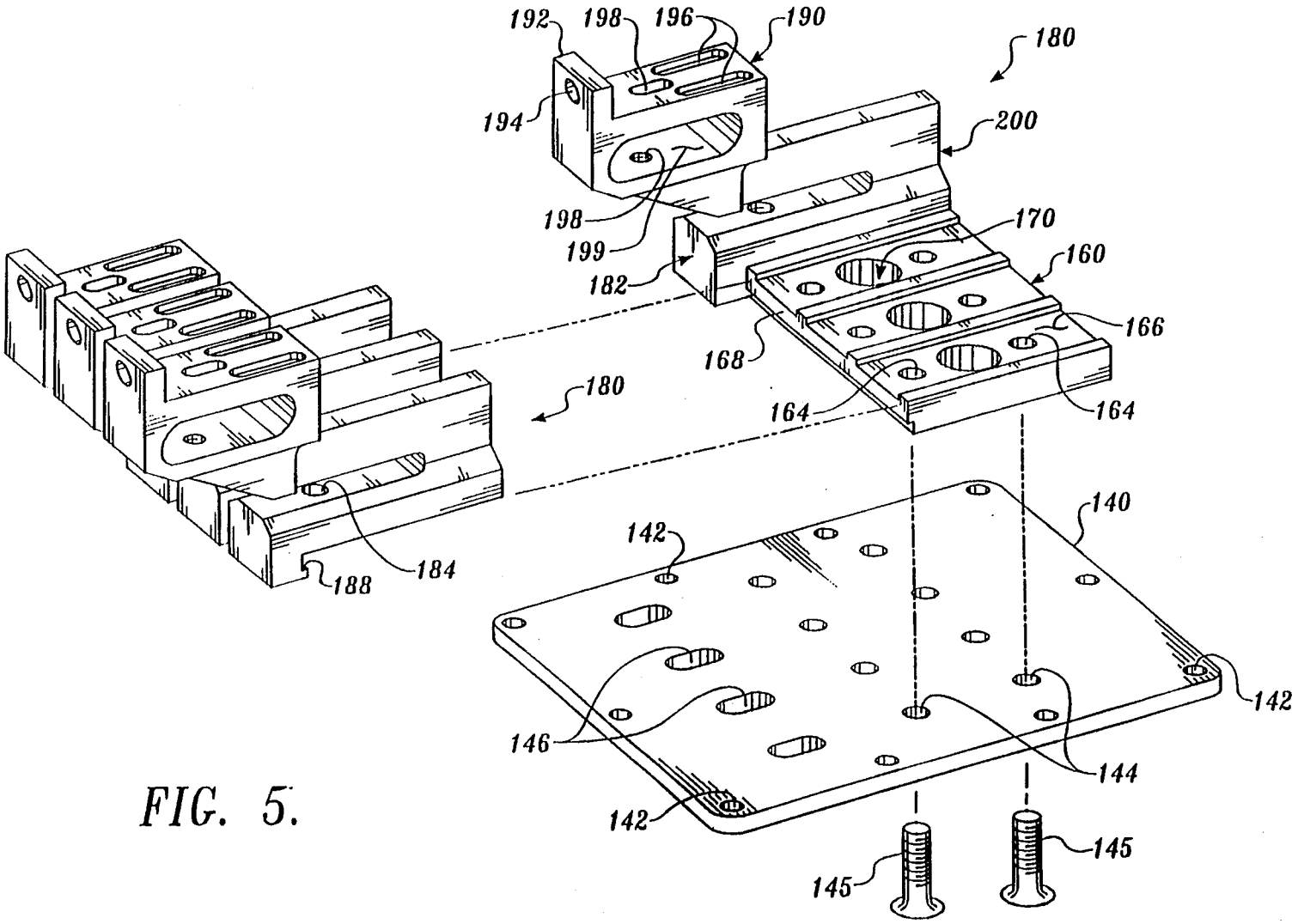
FIG. 5 is an isometric view of a second embodiment of the musical instrument bridge according to the present invention.

FIG. 5 shows a second embodiment of a musical instrument bridge according to the present invention. The second embodiment is designed for use in an electric bass guitar, typically having four strings (not shown). In contrast with the first embodiment described above, the second embodiment in the present invention is designed to withstand the extra stresses produced by the bass guitar strings. The instrument bridge includes a plate 140 having a plurality of holes 142 disposed about the perimeter. The holes 142 receive a screw or other suitable fastening means for securing the bridge to a rear face of a bass guitar (not shown). Also included in the plate 140 are a plurality of holes 144 through which a plurality of machine screws 145 or other suitable fasteners are passed to secure a mounting block 160 to the plate 140. Finally, the plate 140 includes a series of slots 146 through which a bass guitar string may be passed.

The mounting block 160 includes a plurality of holes 164 through which the machine screws 145 are passed and secured to a threaded hole 184 in a finger 180. The mounting block 160 also includes a plurality of slots 166 in which the fingers 180 are fitted and an outwardly extending lip 168 that mates with a corresponding groove 188 on the finger 180. Finally, the mounting block 160 includes a hollowed portion 170 within the slots 166 in order to reduce the weight of the mounting block.

The fingers 180 include a base portion 182, a head portion 190 and a waist portion 200 that extends between the base portion and the head portion. The base portion includes a pair of threaded holes 184 (only one of which is visible) that receive the machine screws 145 in order to secure the finger 180 and mounting block 160 to the plate 140. The groove 188 described above mates with the outwardly extending lip 168 of the mounting block to prevent the finger from rotating forward when the musical instrument is played.

Figure 6:
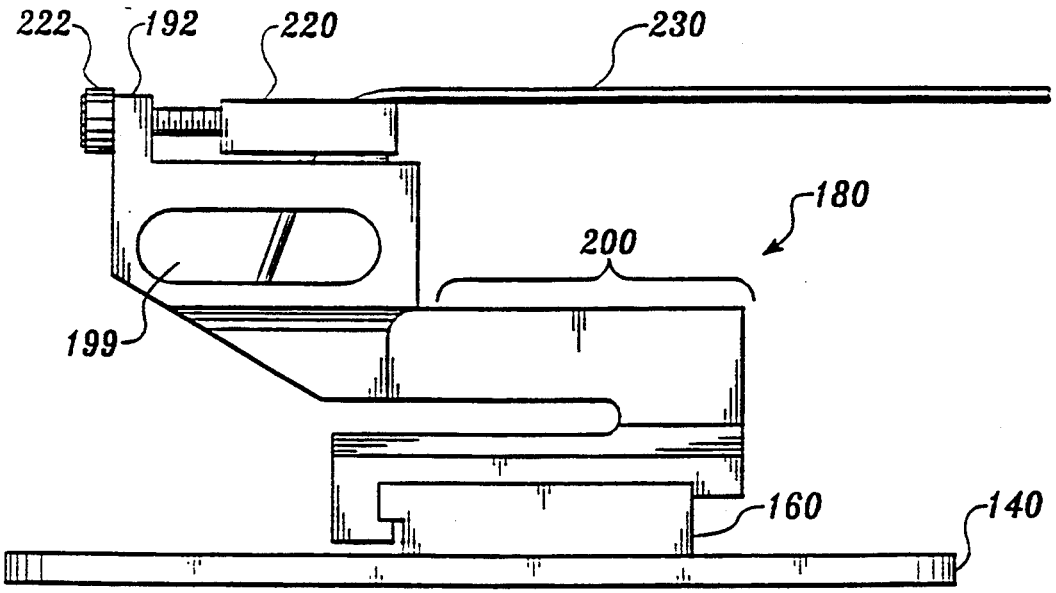
FIG. 6 is a side elevational view of the musical instrument bridge shown in FIG. 5.

The head portion 190 of the finger includes a saddle stop 192 having a hole 194 disposed therein for securing a saddle 220 to the head portion as is shown in FIG. 6. The head portion of the finger 180 further includes a pair of slots 196 that maintain the alignment of the saddle 220 on the finger. The head portion includes a hole 198 through which a string is passed. Finally, an area 199 of the head portion may be hollowed to reduce the weight of the finger.

FIG. 6 is a side elevational view of the musical instrument bridge according to the second embodiment of the present invention. A musical string 230 is secured by the head portion of the finger 180 at the proper height above the fretboard of the musical instrument (not shown). The saddle 220 is secured on top of the finger by an adjustment screw 222 that is threaded through the saddle stop 192.

The finger 180 includes a waist portion that extends between the base portion and the head portion of the finger. As seen in FIG. 6, the waist portion 200 of the finger lies in a direction along the length of the string such that the string passes lengthwise over the waist portion. The waist portion 200 has a width dimension that extends parallel with the plane of the plate 140 and a height dimension that extends perpendicular to the plane of the plate 140. Preferably, the width dimension is smaller than the height dimension in order to allow the string 230 to vibrate the finger in a plane substantially parallel with the plane of the plate 140 but to reduce vibration in a plane perpendicular to the plate 140. This lateral movement reduces distortion that occurs because of the tendency of the string 230 to vibrate in an elliptical path once it is played.

The finger 180 has a resonant frequency that is related to the pitch of the string 230 when the musical instrument is played. The resonant frequency can be adjusted by varying the mass of the finger 180, the width of the waist portion 200 and the materials from which the finger, mounting block and plate are made. It has been determined that brass and stainless steel provide the most appropriate materials from which to make the plate, mounting block and fingers. These materials have been shown to provide the requisite strength and mass required to give the fingers the appropriate resonant frequency. However, those skilled in the art will appreciate that other materials could be used.

As indicated above, the present invention has several advantages over prior art instrument bridges. The first advantage provided by the present invention is the increased harmonic content of a note played. It is believed that vibrations from the string are transferred through the fingers 100 to the plate 60 and into the body of the instrument. These vibrations then interact with the body of the instrument and are returned to the vibrating string via the finger to create a richer, more complex sound. The tone quality of the sound produced by a string is affected by the resonant frequency of each finger 100 on the bridge. The resonant frequency of a finger is adjusted by selecting the material from which the plate, mounting block and fingers are made, as well as by adjusting the mass of the finger itself.

As indicated above, it has been determined that the most suitable materials from which to make the bridge according to the present invention are brass and stainless steel. The mass of the fingers is adjusted by removing material from the head portion and/or the base portion, as well as by adjusting the width dimension of the waist portion of the finger. As was also previously indicated, the optimum resonant frequency for each of the fingers is somewhat a matter of taste. However, it has been determined that if the resonant frequency of the finger is the same as the pitch of the string, the finger will dampen the motion of the string as it is played, thereby producing little or no sound. Thus, the fingers should not have a resonant frequency that is exactly the same as the pitch of the string.

The second advantage of the musical instrument bridge according to the present invention is a reduction in interstring modulation, whereby striking one string of the instrument causes vibration of another string of the instrument. Because all the fingers 100 are independent of each other except for their common connection to the mounting block 80, the vibration of one string on the instrument causes little vibration in the other strings of the instrument. Therefore, the resulting sound produced by the instrument is cleaner with little sympathetic interstring vibration.

The third advantage provided by the present invention is a reduction in the orbital motion of the string as it is struck. The construction of the fingers allows them to vibrate laterally in a plane that is parallel with the plane of the plate and consequently the front face of the instrument. However, the construction of the fingers reduces motion of the string in a plane perpendicular to the plane of the plate. This lateral motion of the string produces the strongest signal in a magnetic pickup and minimizes signal distortion. Thus, the bridge according to the present invention produces cleaner and stronger output signals than are obtained with prior art instrument bridges.

While the preferred embodiment of the invention has been illustrated and described, it will be appreciated that various changes can be made therein without departing from the spirit and scope of the invention. For example, the fingers shown in the first and second embodiments have an "S" shape whereby the base portion of the finger sits lower than the head portion when the bridge is mounted in the instrument. However, the fingers could be made having other configurations such as being straight. The size of the mounting block could be varied to adjust the height of the fingers above the front face of the instrument. Additionally, the fingers could be made having an "L" shape and secured to the plate directly without a mounting block or an "I" shape where the head portion is disposed directly above the base portion. Furthermore, in some instruments it may be desirable to mount the fingers directly to the body of the instrument using a machine screw or the like without using a plate. Finally, although the present invention has been described with respect to electric instruments, the bridge will work with acoustic instruments as well.

The embodiments of the invention in which an exclusive property or privilege is claimed are defined as follows:

1. A musical instrument bridge for supporting a set of strings above a generally planar front face of a musical instrument, said front face extending in a direction generally parallel to the set of strings supported by the bridge, the bridge comprising:

a plate:

means for securing the plate to the musical instrument in a plane extending in a same direction as the plane of the front face of the musical instrument; and a plurality of elongated fingers cantilevered from the plate, each of the plurality of fingers including means for anchoring a string of the set of strings such that the fingers extend in a direction generally lengthwise of the set of strings.

2. The musical instrument bridge of claim 1, further comprising a mounting block secured to the plate and disposed between the plate and the plurality of fingers, wherein each of said fingers has a base portion at which each of the fingers is secured to the mounting block, a head portion that includes the means for anchoring the string of the set of strings of the set of strings and a waist portion that connects the base portion of the finger to the head portion of the finger.

3. The musical instrument bridge of claim 2, wherein the means for anchoring the string is configured to position the string substantially parallel to and above the waist portion of the elongated finger.

4. The musical instrument bridge of claim 2, wherein the mounting block includes a series of slots in which the plurality of fingers are fitted, the mounting block and the base portion of each of the fingers having respective interfitting portions including a groove and an outwardly extending lip received in the groove to secure each of the fingers to the mounting block.

5. The musical instrument bridge of claim 2, wherein the head portion of each finger includes a saddle configured to maintain the height of a string above the front face of the instrument, a saddle stop adjacent to the saddle and an adjustment screw extending through the saddle stop and into the saddle.

6. The musical instrument bridge of claim 1, wherein each of the fingers has a width dimension and a height dimension, the width dimension being smaller than the height dimension so that the finger has the ability to vibrate in a direction parallel to the front face of the instrument and transversely of the set of strings but has limited ability to vibrate in a direction perpendicular to the front face of the instrument.

7. A musical instrument bridge for supporting a set of strings above a generally planar front face of a guitar, comprising:

a plate;

means for securing the plate to the guitar in a plane that is substantially parallel to the front face of the guitar;

a mounting block secured to the plate, the mounting block including a plurality of slots; and a plurality of fingers each having a head portion including means for anchoring an end of a string of the set of strings, a base portion secured in one of the slots of the mounting block and a waist portion that extends between the base portion and head portion of each of the fingers, the mounting block and the base portion of each finger having respective interfitting portions including a groove and an outwardly extending lip received in the groove.

8. The musical instrument bridge of claim 7, wherein each of the fingers is secured to the mounting block independently of any other of said fingers.

9. The musical instrument bridge of claim 7, wherein the waist portion of each of the fingers is elongated and aligned in a direction that is substantially lengthwise to the strings that are anchored by the fingers.

10. A musical instrument, comprising:

a guitar having a front face, a rear face and a neck;

a set of strings; and a bridge for supporting the set of strings above the front face of the guitar, the bridge including:

a) a plate that is secured to the rear face of the guitar;

b) a mounting block secured to the plate, the mounting block including a plurality of slots; and c) a plurality of fingers each having a head portion at which one string of the set of strings is anchored, a base portion secured in one of the slots in the mounting block, and a waist portion that extends between the base portion and the head portion, the mounting block and base portion of each finger having respective interfitting portions including a groove and an outwardly extending lip received in the groove.

11. The musical instrument of claim 10, wherein each of the fingers is secured to the mounting block independently of any other of said fingers.

12. The musical instrument of claim 10, wherein the waist portion of each of the fingers is elongated and aligned in direction that is substantially lengthwise to the strings that are anchored by the fingers.

13. The musical instrument of claim 10, wherein each of the fingers has a width dimension and a height dimension, the width dimension being smaller than the height dimension so that the finger has the ability to vibrate in a direction parallel to the front face of the guitar and transversely to the set of strings, but has limited ability to vibrate in a direction perpendicular to the front face of the guitar.

14. The musical instrument of claim 10, wherein the head portion of each of the fingers includes a saddle for adjusting the height of the string anchored by the finger above the front face of the guitar, a saddle stop adjacent to the saddle, and an adjustment screw extending through the saddle stop and into the saddle.

15. The musical instrument of claim 14, wherein the guitar is a bass guitar, the set of stings includes at least four strings and the bridge includes at least four fingers.

16. A musical instrument, comprising:

a guitar having a front face, a rear face and a neck;

a set of strings; and a bridge for supporting the set of strings above the front face of the guitar, said front face extending in a direction generally parallel to the set of strings, the bridge including:

a) a plate secured to the rear face of the guitar and extending in the same direction as the front face of the guitar; and b) a plurality of elongated fingers cantilevered from the plate, each of the plurality of fingers including means for anchoring a string of the set of strings such that the fingers extend in a direction generally lengthwise of the set of strings.

* * * * *